US010941965B2

(12) United States Patent
Diemer Lopes

(10) Patent No.: US 10,941,965 B2
(45) Date of Patent: Mar. 9, 2021

(54) SYSTEM AND METHOD FOR PROVIDING SUPPLEMENTAL HEAT TO A REFRIGERANT IN AN AIR-CONDITIONER

(71) Applicant: Mitsubishi Electric US, Inc., Cypress, CA (US)

(72) Inventor: Luiz Antonio Diemer Lopes, Duluth, GA (US)

(73) Assignee: MITSUBISHI ELECTRIC US, INC., Cypress, CA (US)

( * ) Notice: Subject to any disclaimer, the term of this patent is extended or adjusted under 35 U.S.C. 154(b) by 267 days.

(21) Appl. No.: 15/977,378

(22) Filed: May 11, 2018

(65) Prior Publication Data

US 2019/0346187 A1 Nov. 14, 2019

(51) Int. Cl.
*F25B 29/00* (2006.01)
*F25D 17/02* (2006.01)
(Continued)

(52) U.S. Cl.
CPC ..... *F25B 29/003* (2013.01); *F24D 17/02* (2013.01); *F24F 5/0096* (2013.01); *F25D 17/02* (2013.01)

(58) Field of Classification Search
CPC ..... F25D 17/02; F24D 17/02; F24F 5/0096; F25B 29/003; F25B 2500/31;
(Continued)

(56) References Cited

U.S. PATENT DOCUMENTS 2,710,725 A * 6/1955 Duy ..... F24D 3/02 237/8 C
2,907,178 A * 10/1959 McNatt ..... F24F 1/01 62/95

(Continued)

FOREIGN PATENT DOCUMENTS

CN 206222768 U 6/2017
EP 2597400 B1 3/2017

(Continued)

OTHER PUBLICATIONS

Shandong Xinmeng Refrigeration Equipment Co., Ltd. (Nov. 4, 2008). Heat Pump Mechanics. Retrieved from http://www.cniceworld.com/enshownews.asp?id=158.

*Primary Examiner* — Len Tran
*Assistant Examiner* — Kirstin U Oswald
(74) *Attorney, Agent, or Firm* — Posz Law Group, PLC

(57) ABSTRACT

A supplemental heat-providing system is provided for heating a refrigerant. The system includes an outdoor unit that can act as a heat pump located outside a building and configured to use the refrigerant to condition an indoor space inside the building; a hot water heater located in the building and connected to one or more points of use in the building, the hot water heater being configured to heat water and provide the water to the one or more points of use; a water-refrigerant heat exchanger containing a refrigerant pathway and a water pathway, configured to pass the refrigerant from the outdoor unit through the refrigerant pathway, to pass the water from the hot water heater through the water
(Continued)

pathway, and to exchange heat from the water to the refrigerant; and a water pump configured to selectively pump the water from the hot water heater through water pathway.

9 Claims, 9 Drawing Sheets

(51) Int. Cl.
*F24D 17/02* (2006.01)
*F24F 5/00* (2006.01)

(58) Field of Classification Search
CPC ..... F25B 2313/0315; F25B 2313/025; F25B 2313/004; F25B 13/00; F25B 2700/2106
USPC ..... 62/238.6
See application file for complete search history.

(56) References Cited

U.S. PATENT DOCUMENTS 3,583,601 A * 6/1971 Ayers ..... B67D 1/0016 222/1
3,894,690 A * 7/1975 Hill ..... B05B 12/1418 239/126
4,136,731 A * 1/1979 DeBoer ..... F24D 17/0052 165/267
4,165,037 A * 8/1979 McCarson ..... F24F 3/001 237/1 R
4,191,023 A * 3/1980 Sisk ..... F24D 11/0271 62/79
4,226,606 A * 10/1980 Yaeger ..... F24D 17/02 62/238.6
4,238,933 A * 12/1980 Coombs ..... F24D 11/0235 62/238.7
4,241,588 A * 12/1980 Murphy ..... F24D 17/02 165/901
4,248,059 A * 2/1981 Dearling ..... F25B 13/00 62/238.7
4,285,209 A * 8/1981 Luthi ..... F25B 30/04 62/238.3
4,316,367 A * 2/1982 Yaeger ..... F24D 17/02 62/238.6
4,321,797 A * 3/1982 Yaeger ..... F24D 17/02 62/238.6
4,339,930 A * 7/1982 Kirts ..... F24D 19/1075 126/585
4,391,104 A * 7/1983 Wendschlag ..... F25B 30/02 62/79
4,417,546 A * 11/1983 Hoskinson ..... F24D 11/002 110/234
4,487,032 A * 12/1984 Speicher ..... F24D 17/02 62/183
4,498,622 A * 2/1985 Harnish ..... F24D 19/1054 122/14.3
4,545,214 A * 10/1985 Kinoshita ..... F24D 11/02 62/160
4,633,676 A * 1/1987 Dittell ..... F24D 11/0214 62/238.6
4,646,537 A * 3/1987 Crawford ..... F24D 5/12 62/238.6
4,727,727 A * 3/1988 Reedy ..... F24D 17/02 62/238.6
5,269,153 A * 12/1993 Cawley ..... F24D 17/02 165/103
5,305,614 A * 4/1994 Gilles ..... F24F 5/0096 62/238.7
5,351,502 A * 10/1994 Gilles ..... F24D 17/02 62/238.7
5,381,670 A * 1/1995 Tippmann ..... A23L 3/36 62/330
5,727,396 A * 3/1998 Boyd ..... F24D 3/18 62/323.1
5,947,373 A * 9/1999 Saito ..... F24F 1/0003 165/240
6,405,551 B1 * 6/2002 Kuwabara ..... F24D 17/02 62/238.7
6,574,977 B2 * 6/2003 Ozaki ..... B60H 1/00792 62/210
6,601,773 B2 * 8/2003 Saitoh ..... F24D 19/1054 165/140
6,769,481 B2 * 8/2004 Yoshimura ..... F24F 1/44 165/240
7,287,581 B2 * 10/2007 Ziehr ..... B60L 50/40 165/202
9,605,882 B2 3/2017 Hancock
2003/0178498 A1 * 9/2003 Saitoh ..... F24D 17/02 237/2 B
2004/0244394 A1 * 12/2004 Nakayama ..... F25B 40/00 62/190
2005/0066678 A1 * 3/2005 Kamimura ..... F25B 29/003 62/238.7
2005/0111991 A1 * 5/2005 Chida ..... F24D 17/02 417/207
2005/0163681 A1 * 7/2005 Takao ..... F25D 17/02 422/198
2006/0213209 A1 * 9/2006 Tanaami ..... F24D 19/1054 62/238.6
2006/0225448 A1 * 10/2006 Feger ..... F17C 9/04 62/238.6
2007/0056302 A1 * 3/2007 Otake ..... F25B 9/008 62/243
2007/0199337 A1 * 8/2007 Otake ..... F24D 17/02 62/183
2007/0246555 A1 * 10/2007 Nishimura ..... F24D 11/0214 237/2 B
2007/0295018 A1 * 12/2007 Williams ..... F25B 29/003 62/238.6
2008/0127665 A1 * 6/2008 Fournier ..... F04B 39/06 62/238.1
2008/0142094 A1 * 6/2008 Takada ..... F24D 17/02 137/551
2009/0113911 A1 * 5/2009 Nakayama ..... F24D 17/02 62/238.6
2009/0211282 A1 * 8/2009 Nishimura ..... F25B 13/00 62/238.6
2010/0031953 A1 * 2/2010 Penev ..... F24D 19/106 126/615
2010/0155312 A1 * 6/2010 Numata ..... F24D 19/0092 210/96.1
2010/0186604 A1 * 7/2010 Otake ..... F25B 29/003 99/455
2010/0319377 A1 * 12/2010 Moriwaki ..... C09K 5/045 62/238.6
2010/0319378 A1 * 12/2010 Chikami ..... F28F 1/20 62/238.7
2011/0023512 A1 * 2/2011 Kawagoe ..... F25B 13/00 62/196.1
2011/0061418 A1 * 3/2011 Ishihara ..... F24H 4/04 62/324.3
2011/0315091 A1 * 12/2011 Adachi ..... F24D 19/1054 122/14.1
2012/0042673 A1 * 2/2012 Noh ..... F24D 3/08 62/159
2012/0151950 A1 * 6/2012 Jagusztyn ..... F28D 7/1684 62/228.1
2012/0180984 A1 * 7/2012 Fujitsuka ..... F25B 25/005 165/61
2013/0104574 A1 * 5/2013 Dempsey ..... F24D 17/02 62/79
2015/0052914 A1 * 2/2015 Leman ..... F25B 49/027 62/79
2016/0123644 A1 * 5/2016 Yoshimi ..... H02J 3/14 62/160
2016/0209085 A1 7/2016 Kim et al.

(56) References Cited

U.S. PATENT DOCUMENTS

| | | | | |
|---|---|---|---|---|
| 2017/0067652 | A1 | 3/2017 | Bush et al. | |
| 2018/0051894 | A1* | 2/2018 | Yoshida | F24D 17/02 |

FOREIGN PATENT DOCUMENTS

| | | | |
|---|---|---|---|
| JP | 2000-346479 | A | 12/2000 |
| JP | 4178447 | B2 | 11/2008 |

* cited by examiner

SYSTEM AND METHOD FOR PROVIDING SUPPLEMENTAL HEAT TO A REFRIGERANT IN AN AIR-CONDITIONER

FIELD OF THE INVENTION

The present invention relates generally to air-conditioning systems that condition an indoor space in a building using a refrigerant. More particularly, the present invention relates to a system that can provide supplemental heat to the refrigerant during cold weather using hot water from a hot water heater.

BACKGROUND OF THE INVENTION

Many conventional air-conditioning systems use a heat pump to provide heating during colder temperatures. A heat pump is typically located in an outdoor unit in the air-conditioning system, and operates to transfer heat from a nearby heat source (e.g., outside air or the ground or groundwater) to a refrigerant in the heat pump. This refrigerant is then used to heat an indoor space in an adjacent building.

The effectiveness of a heat pump can be represented by its coefficient of performance, a number that describes the ratio of useful heat movement per work input for the heat pump. The coefficient of performance varies depending upon the temperature of the heat source used by the heat pump, with the coefficient of performance being smaller when the temperature of the heat source becomes smaller. For example, a heat pump using ambient air as a heat source may have a coefficient of performance of 3.0 or 4.0 at an outside temperature of 10° C. The coefficient of performance can drop to 1.0 when the outside temperature drops to −18° C. At this point, the heat pump is not able to draw enough heat out of the outside air to effectively heat the indoor space.

Because of this loss of efficiency, some air-conditioning systems employ an auxiliary heater, e.g., a furnace, baseboard heating, etc., to assist in heating the indoor space when the temperature drops below certain thresholds. This auxiliary heater activates when the temperature gets too low and deactivates when the temperature rises again. It is generally preferable to use the heat pump at higher temperatures, since it will typically have a higher coefficient of performance at those higher temperatures.

Some air-conditioning systems use a supplemental (or secondary) heater (e.g., a resistive electric heater) to assist the heat pump in colder weather. This supplemental heater operates to heat a quantity of ambient air that the heat pump can then use as a heat source to heat the indoor space. For example, the heat pump can have an insulated interior space that can be heated by an electric heater. When the temperature drops below a set threshold temperature, the electric heater is activated, heating the air inside the insulated interior space to a higher temperature. The heat pump can then use this warmer interior air as a heat source for its refrigerant rather than the colder exterior air. In this way, the heat pump can maintain a higher coefficient of performance and more effectively heat the interior space.

However, while such a supplemental heater can be effective in allowing a heat pump to operate at extremely low temperatures, it will also increase the size, complexity, and cost of the heat pump. For example, it requires an insulated interior space (i.e., some sort of enclosure or cabinet) to allow air heat transfer between the refrigerant and the heated air, as well as a heater to heat the internal air.

It would therefore be desirable to provide a mechanism to allow a heat pump to operate at low ambient temperatures with a minimum of extra components, operating at a higher efficiency

SUMMARY OF THE INVENTION

A supplemental heat-providing system is provided for heating a refrigerant, comprising: an outdoor unit that can act as a heat pump located outside a building and configured to use the refrigerant to condition an indoor space inside the building; a hot water heater located in the building and connected to one or more points of use in the building, the hot water heater being configured to heat water and provide the water to the one or more points of use; a water-refrigerant heat exchanger containing a refrigerant pathway and a water pathway, configured to pass the refrigerant from the outdoor unit through the refrigerant pathway, to pass the water from the hot water heater through the water pathway, and to exchange heat from the water in the water pathway to the refrigerant in the refrigerant pathway; and a water pump configured to selectively pump the water from the hot water heater through water pathway in the hydronic circuit.

The water-refrigerant heat exchanger may be formed inside the outdoor unit, or the water-refrigerant heat exchanger may be connected to an outside of the outdoor unit.

The water may be potable water.

The supplemental heat-providing system may further comprise water pipes extending between the hot water heater and the water pathway of the water-refrigerant heat exchanger, configured to carry the water between the hot water heater and the water-refrigerant heat exchanger.

The supplemental heat-providing system may further comprise a temperature sensor configured to determine a temperature of one of the water pipes or the water-refrigerant heat exchanger.

The supplemental heat-providing system may further comprise thermal insulation surrounding at least one of the first, second, and third water pipes.

The supplemental heat-providing system may further comprise an antifreeze circuit configured to heat at least one of the water pipes and the water-refrigerant heat exchanger.

The antifreeze circuit may comprise one of an electric strip heater or an electric foil heater.

The water pump may be further configured to selectively pump water out of the water-refrigerant heat exchanger and into the hot water heater.

The water-refrigerant heat exchanger may include a hydronic coil.

A supplemental heat-providing system is provided for heating a refrigerant, comprising: an outdoor unit that can operate as a heat pump located outside a building configured to use the refrigerant to provide heat to an indoor space inside the building; a hot water heater located inside the building and connected to one or more points of use in the building, the hot water heater being configured to heat water and provide the water to the one or more points of use; a water-refrigerant heat exchanger containing a refrigerant pathway and a water pathway, configured to pass the refrigerant from the outdoor unit through the refrigerant pathway, to pass the water from the hot water heater through the water pathway, and to exchange heat from the water in the water pathway to the refrigerant in the refrigerant pathway; a water pump configured to selectively pump the water from the hot water heater through the water pathway in the water-refrigerant heat exchanger; a first water pipe connected between the hot water heater and an input of the water pump; a second water pipe connected between an output of the water pump and the water pathway of the water-refrigerant heat exchanger; a third water pipe connected between the water pathway of the water-refrigerant heat exchanger and the hot water heater; a first bypass pipe connected between the input of the water pump and the water pathway of the water-refrigerant heat exchanger; a second bypass pipe connected between the output of the water pump and the hot water heater; a check valve located on the third water pipe, configured to prevent water flow from the hot water heater to the water pathway of the water-refrigerant heat exchanger along the third water pipe; a first valve located on the first water pipe and configured to control water flow between the hot water heater and the input of the water pump; a second valve located on the first bypass pipe, configured to control water flow between the input of the water pump and the water pathway of the water-refrigerant heat exchanger; a third valve located on the second water pipe, configured to control water flow between the output of the water pump and the water pathway of the water-refrigerant heat exchanger; and a fourth valve located on the second bypass pipe, configured to control water flow between the output of the water pump and the hot water heater.

The first, second, third, and fourth valves may be solenoid valves.

The water-refrigerant heat exchanger may be connected to an outside of the outdoor unit.

The water-refrigerant heat exchanger may be located outside of the outdoor unit and closer to the outdoor unit than to the hot water heater.

The water may be potable water.

The supplemental heat-providing system may further comprise a temperature sensor configured to determine a temperature of at least one of the first, second, third, or fourth water pipes or the water-refrigerant heat exchanger.

The supplemental heat-providing system may further comprise thermal insulation surrounding at least one of the first, second, and third water pipes.

The supplemental heat-providing system may further comprise an antifreeze circuit configured to heat at least one of the first, second, third, or fourth water pipes or the water-refrigerant heat exchanger.

The antifreeze circuit may comprise one of an electric strip heater or an electric foil heater.

The water pump may be further configured to selectively pump water out of the water-refrigerant heat exchanger and into the hot water heater via at least the first bypass pipe and the second bypass pipe.

The water-refrigerant heat exchanger may include a hydronic coil.

A method of providing supplemental heat for a refrigerant is provided, comprising: heating water in a hot water heater in a building; providing the water from the hot water heater to one or more points of use in the building; circulating the refrigerant in an outdoor unit that can be used as a heat pump outside the building; determining whether heating of the refrigerant is required; pumping the water from the hot water heater to a water-refrigerant heat exchanger when it is determined that heating of the refrigerant is required; pumping the refrigerant from the outdoor unit to the water-refrigerant heat exchanger when it is determined that heating of the refrigerant is required; exchanging heat between the water and the refrigerant in the water-refrigerant heat exchanger when water is pumped to the water-refrigerant heat exchanger and the refrigerant is pumped to the water-refrigerant heat exchanger.

The water may be potable water.

The method may further comprise: determining a temperature of one of the water-refrigerant heat exchanger or water pipes connecting the hot water heater to the water-refrigerant heat exchanger; determining whether the temperature is below a temperature threshold; and activating an antifreeze circuit when the temperature is below the temperature threshold.

The antifreeze circuit may be one of electric strip heaters or electric foil heaters attached to at least one of the water pipes or the hydronic circuit.

The antifreeze circuit may operate to maintain a circulation of water from the hot water heater through the water pipes and the water-refrigerant heat exchanger when the temperature is below the temperature threshold.

The method may further comprise pumping the water from the water-refrigerant heat exchanger to the hot water heater when it is determined that heating of the refrigerant is not required.

The determining of whether heating of the refrigerant is required may further include: determining whether the heat pump is in a cooling mode or a heating mode; determining an outdoor temperature proximate to the heat pump; determining that heating of the refrigerant is required when the heat pump in in a heating mode and the outdoor temperature is below a set temperature threshold.

BRIEF DESCRIPTION OF THE DRAWINGS

The accompanying figures where like reference numerals refer to identical or functionally similar elements and which together with the detailed description below are incorporated in and form part of the specification, serve to further illustrate an exemplary embodiment and to explain various principles and advantages in accordance with the present disclosure.

DETAILED DESCRIPTION

The instant disclosure is provided to further explain in an enabling fashion the best modes of performing one or more embodiments of the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms such as first and second, and the like, if any, are used solely to distinguish one from another entity, item, or action without necessarily requiring or implying any actual such relationship or order between such entities, items or actions. It is noted that some embodiments may include a plurality of processes or steps, which can be performed in any order, unless expressly and necessarily limited to a particular order; i.e., processes or steps that are not so limited may be performed in any order.

Supplemental Heat-Providing System

One way of allowing a heat pump to operate at a low outside temperature is to provide a supplemental heat-providing system for the heat pump that takes advantage of an existing heat source—the hot water heater present in almost every building with internal plumbing. A hot water heater maintains a quantity of water at a high temperature for use in the building, distributing it at need. As shown below, the hot water from a hot water heater can be diverted from the hot water heater to provide heat to the refrigerant from the heat pump, allowing the heat pump to operate effectively even at extremely low temperatures.

Figure 1:
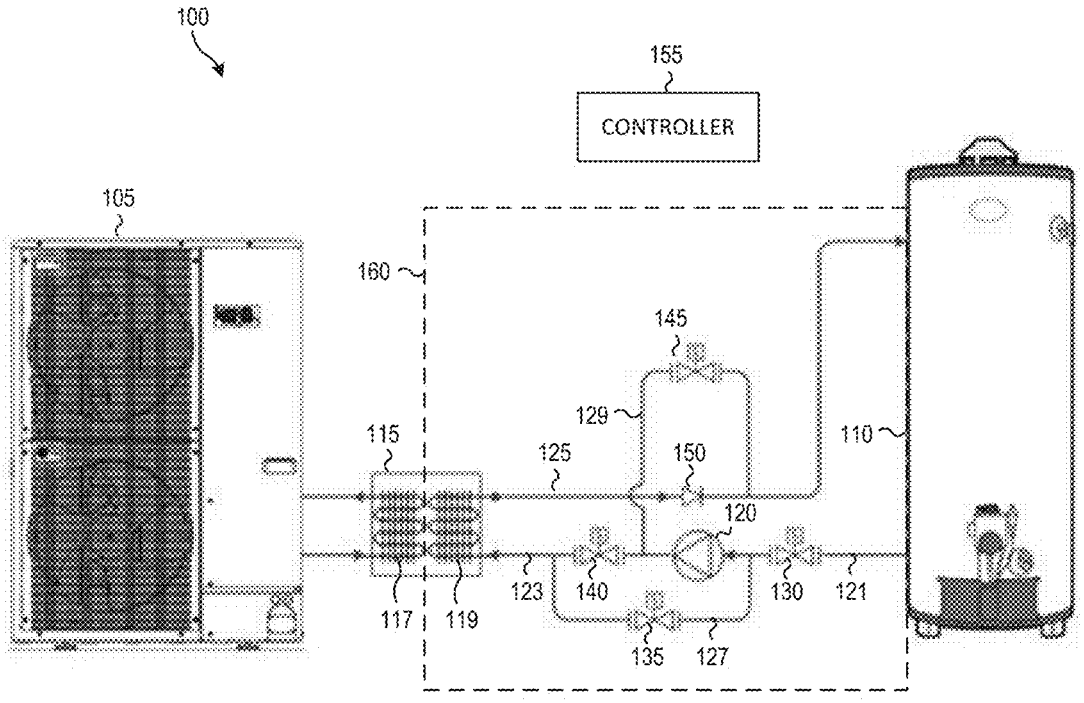
FIG. 1 is a block diagram of a supplemental heat-providing system according to a first disclosed embodiment.

FIG. 1 is a block diagram of a supplemental heat-providing system 100 according to a first disclosed embodiment.

As shown in FIG. 1, the supplemental heat-providing system 100 includes an outdoor unit 105, a hot water heater 110, a water-refrigerant heat exchanger 115, a water pump 120, a first water pipe 121, a second water pipe 123, a third water pipe 125, a first bypass pipe 127, a second bypass pipe 129, a first valve 130, a second valve 135, a third valve 140, a fourth valve 145, a check valve 150, and a controller 155.

The outdoor unit 105 is an outdoor component of a conventional air-conditioning system. It can either include a heat pump or can operate as a heat pump, providing heat to an indoor space inside of a building using a refrigerant as a heat exchange mechanism. In a heating mode, the heat pump operates to exchange ambient heat (e.g., from outside air) with the refrigerant to provide the heat required to heat the indoor space in a manner that would be understood by one skilled in the air-conditioning arts.

This outdoor unit 105 can be a conventional outdoor unit used in a conventional air-conditioning system. However, the outdoor unit 105 will require connections that allow the refrigerant in the outdoor unit 105 to flow out of the outdoor unit 105 into the water-refrigerant heat exchanger 115 and back from the water-refrigerant heat exchanger 115 into the outdoor unit 105. These connections can be pre-existing connections for access to the refrigerant, e.g., refrigerant drainage access valves, or can involve modifications to a conventional outdoor unit 105 to provide such access. Regardless, providing access to the refrigerant can be easily made without significant increases in complexity, size, or cost of the outdoor unit 105.

The hot water heater 110 operates to heat water for use inside the building, e.g., in faucets, showers, washing machines, dishwashers, etc. The hot water heater 110 can also be referred to as a hot water tank or a boiler. When in domestic use, the hot water heater 110 will generally heat potable water suitable for individual use by the residents of the building. However, the hot water heater 110 may be an industrial hot water heater that heats non-potable water for industrial uses.

In addition to being provided to the occupants of the building, the hot water heated by the hot water heater 110 can also be diverted to the water-refrigerant heat exchanger 115 so that it can exchange heat with the refrigerant from the outdoor unit 105. In this way, the refrigerant can be heated even in conditions when the outdoor temperature is too low to allow the heat pump in the outdoor unit 105 to absorb enough heat to adequately heat the indoor space.

In the disclosed embodiments, the hot water heater 110 is a storage water heater that maintains a quantity of water at a high temperature for immediate use. In alternate embodiments, however, the hot water heater 110 can be a different system for providing hot water. For example, the hot water heater 110 could be a centralized or district water heater that is provided at a remote location and services multiple buildings, a tankless water heater that instantly heats water as it flows through the device to generate hot water, or any other suitable mechanism for generating hot water.

The hot water heater 110 can be a conventional hot water heater used to heat water for use in a building. However, the hot water heater 110 will require connections that allow the hot water from the hot water heater 110 to flow out of the hot water heater 110 into the water-refrigerant heat exchanger 115 and back from the water-refrigerant heat exchanger 115 into the hot water heater 110. These connections can be pre-existing connections for access to the hot water, e.g., water drainage access valves or high-pressure release valves, or can involve modifications to a conventional hot water heater 110 to provide such access. Regardless, providing access to the refrigerant can be easily made without significant increases in complexity, size, or cost of the hot water heater 110.

The water-refrigerant heat exchanger 115 receives refrigerant from the outdoor unit 105 and hot water from the hot water heater 110, and facilitates the transfer of heat from the hot water to the refrigerant. In the disclosed embodiment, the water-refrigerant heat exchanger 115 includes a refrigerant pathway 117 and a hot water pathway 119. The refrigerant pathway 117 may be a pipe coil that is connected to the outdoor unit 105 and allows the refrigerant to flow through it. Likewise, the hot water pathway 119 may be a pipe coil that is connected to the hot water heater 110 and allows the hot water to flow through it. The hot water pathway may also be called a hydronic coil.

The refrigerant pathway 117 and the hot water pathway 119 are preferably formed proximate to each other such that heat can easily transfer from the hot water in the hot water pathway 119 to the refrigerant in the refrigerant pathway 117.

Alternate embodiments can employ any suitable structure for the refrigerant pathway 117 and the hot water pathway 119 that facilitates the passage of refrigerant and hot water and the transfer of heat from the hot water to the refrigerant. For example, the refrigerant pathway 117 and hot water pathway 119 could be formed to be parallel to each other, intertwined with each other, etc.

In the disclosed embodiments, the water-refrigerant heat exchanger 115 is connected to the outdoor unit 105 at a location proximate to the outdoor unit 105, and is connected more remotely to the hot water heater 110 through the pipes 121, 123, 125, 127, 129. In this way, the water-refrigerant heat exchanger 115 is located closer to the outdoor unit 105 than to the hot water heater 110. However, in an alternate embodiment, the water-refrigerant heat exchanger 115 can be located at any position relative to the outdoor unit 105 and the hot water heater 110.

In the disclosed embodiments the water-refrigerant heat exchanger 115 is formed outside of the outdoor unit 105 so that a conventional outdoor unit 105 can be used. However, alternate embodiments can include the water-refrigerant heat exchanger 115 inside the outdoor unit 105.

In one embodiment, the water-refrigerant heat exchanger 115 can be a device attached to the outside of the outdoor unit 105. This allows for a short trip for the refrigerant between the outdoor unit 105 and the water-refrigerant heat exchanger 115. However, as noted above, this is by way of example only. Alternate embodiments can locate the water-refrigerant heat exchanger 115 anywhere in between the outdoor unit 105 and the hot water heater 110.

The water pump 120 operates to pump water from the hot water heater through the hot water pathway 119 in the water-refrigerant heat exchanger 115. In the disclosed embodiment the water pump 120 is located between the first water pipe 121 and the second water pipe 123. However, in alternate embodiments the water pump 120 may be located anywhere between the hot water heater 110 and the water-refrigerant heat exchanger 115 where it can pump the hot water from the hot water heater 110 to the hot water pathway 119.

Although not shown, the supplemental heat-providing system 100 will also have a pump of some kind to move the refrigerant from the outdoor unit 105 through the refrigerant pathway 117 in the water-refrigerant heat exchanger 115. This pump may be located in the outdoor unit 105 or in between the outdoor unit 105 and the water-refrigerant heat exchanger 115.

The first water pipe 121 is located between a water outlet on the hot water heater 110 and the inlet of the water pump 120. The second water pipe 123 is located between the outlet of the water pump 120 and an inlet port of the hot water pathway 119. The third water pipe 125 is located between the outlet port of the hot water pathway 119 and a water inlet port of the hot water heater 110. In this way, the first, second, and third water pipes 121, 123, 125 provide a pathway for the hot water to pass from the hot water heater 110 to the hot water pathway 119 and back again.

By running the water pump 120, the hot water is taken from the hot water heater 110, passes through the first and second water pipes 121, 123 to the hot water pathway 119, passes through the hot water pathway 119, and then passes through the third water pipe 125 back to the hot water heater 110. The system 100 can therefore circulate hot water from the hot water heater 110 to the water-refrigerant heat exchanger 115.

The first bypass pipe 127 is connected between the inlet of the water pump 120 and a water inlet on the hot water pathway 119 of the water-refrigerant heat exchanger 115. The second bypass pipe 129 is connected between the outlet of the water pump 120 and a water inlet on the hot water heater 110.

The combination of the first and second bypass pipes 127, 129 provides a path for hot water to be pumped out of the hot water pathway 119 without fresh hot water being pumped into the hot water pathway 119. This can be useful when the temperature is low, but there is no need to transfer heat from the hot water to the refrigerant, e.g., when there is no need to heat the interior space in the building. This allows the hot water to be pumped out of the hot water pathway 119 and the pipes 121, 123, 125, 127, 129, where it might otherwise freeze in the low temperature. Absent some ability to drain the water pathway 119 and the pipes 121, 123, 125, 127, 129, it would be necessary to take other measures during extreme cold to prevent the hot water passing through the water pathway 119 and the pipes 121, 123, 125, 127, 129 from cooling and eventually freezing. For example, it might be necessary to have and operate heating elements on the water pathway 119 and the pipes 121, 123, 125, 127, 129, or to constantly circulate hot water to maintain its temperature. Such operations would add to the complexity and cost of the system and its operation.

The first valve 130 is located on the first water pipe 121; the second valve 135 is located on the first bypass pipe 127; the third valve 140 is located on the second water pipe 123; and the fourth valve 145 is located on the second bypass valve 129. The first, second, third, and fourth valves 130, 135, 140, 145 are selectively opened and closed to switch the system between a pumping mode in which hot water is circulated from the hot water heater 110, through the hot water pathway 119, and back to the hot water heater 110, and a pump-out mode in which the hot water is pumped from the hot water pathway 119 back to the hot water heater 110 without any hot water replacing it.

In the disclosed embodiment, the first, second, third, and fourth valves 130, 135, 140, 145 are solenoid valves. However, alternate embodiments can use other types of valves as would be desirable.

The operation logic for the first, second, third, and fourth valves 130, 135, 140, 145 in the disclosed embodiment is as shown in Table 1. With these connections, during a pumping mode, the first and second bypass pipes 127, 129 will be closed, blocking water flow, while the first and second water pipes 121, 123 will be open, allowing water flow. This will allow hot water to be circulated through the hot water pathway 119 from the hot water heater 110. In contrast, during a pump-out mode, the first and second bypass pipes 127, 129 will be open, allowing hot water to flow, while the first and second water pipes 121, 123 will be closed, blocking water flow. This will allow hot water to be pumped from the hot water pathway 119 back to the hot water heater 110 without any hot water being sent to replace it.

TABLE 1

| | Pumping Mode | Pump-out Mode |
|---|---|---|
| First Valve 130 | OPEN | CLOSED |
| Second Valve 135 | CLOSED | OPEN |
| Third Valve 140 | OPEN | CLOSED |
| Fourth Valve 145 | CLOSED | OPEN |

The check valve 150 is located on the third water pipe 125 and operates to prevent hot water from flowing from the hot water heater 110 to the hot water pathway 119 over the third water pipe 150. The check valve 150 is configured to allow water to flow in only one direction (i.e., from the hot water pathway 119 to the hot water heater 110), and not in the other direction.

The controller 155 is dedicated control logic that is configured to control the operation of the outdoor unit 105, the water pump 120, and the first through fourth valves 130, 135, 140, 145. The controller 155 controls the mode of operation of the outdoor unit 105 and the pumping of the refrigerant through the refrigerant pathway 117; it instructs the water pump 120 to turn on and off; and it opens and closes the first through fourth valves 130, 135, 140, 145 to set the system 100 into a pumping mode or a pump-out mode, as appropriate.

Although specific connections are not shown in FIG. 1, the controller 155 will have the connections necessary to control operation of the outdoor unit 105, the water pump 120, and the first through fourth valves 130, 135, 140, 145.

The hot water pathway 119, water pump 120, first through third water pipes 121, 123, 125, first and second bypass pipes 127, 129, first through fourth valves 130, 135, 140, 145, and check valve 150 can be collectively referred to as a hydronic circuit 160. The hydronic circuit 160 serves to circulate hot water from the hot water heater 110 in a manner that allows the hot water to exchange heat with the refrigerant from the outdoor unit 105.

Supplemental heat provided by the hot water from the hot water heater 110 represents and performs as a secondary heat source, having temperatures above the outdoor temperature during operation, thus allowing the heat pump in the outdoor unit 105 to effectively exchange heat (i.e., extract heat) with (from) the secondary heat source (i.e., the hot water). The heat pump in the outdoor unit 105 can thus operate efficiently and supply heating to conditioned spaces in the building even at very low outdoor temperatures, and/or under conditions in which a traditional heat pump would not be capable of, or effective at, operating.

When the outdoor unit 105 is operating in a heat pump mode and the outdoor temperature is above a set secondary-heating temperature threshold (e.g., in the range of 0 to 20° F.), the hydronic circuit 160 may be deactivated (i.e., instructed not to pump hot water to the hot water pathway 119), and the outdoor unit's 105 standard condenser coil (i.e., refrigerant-to-air) will exchange heat with (i.e., absorb heat from) the ambient outside air. In other words, the outdoor unit 105 will engage in a conventional heating operation.

Likewise, when the outdoor unit 105 is operating in a cooling mode, the hydronic circuit 160 can be is deactivated, and the outdoor unit's 105 standard condenser coil (i.e., refrigerant-to-air) will exchange heat with (i.e., reject heat to) the ambient outside air. In other words, the outdoor unit 105 will engage in a normal cooling operation.

Although FIG. 1 discloses an exemplary embodiment that provides a specific connection of a water pump 120, pipes 121, 123, 125, 127, 129, and valves 130, 135, 140, 145, 150, this is by way of example only. Alternate embodiments and arrangements are possible that circulate hot water from the hot water heater 110 to the hot water pathway 119.

Pumping Mode

When the outdoor unit 105 is in a heating mode, it operates to heat one or more indoor spaces in the building through heat exchange with the refrigerant. When the outdoor unit 105 is in a heating mode and the outdoor temperature is below the set secondary-heating temperature threshold (e.g., in the range of 0 to 20° F.), the supplemental heat-providing system 100 will be operated in a pumping mode in which hot water will be pumped from the hot water heater 110 through the hydronic circuit 160 to circulate through the hot water pathway 119, where it can exchange heat with the refrigerant.

Figure 2:
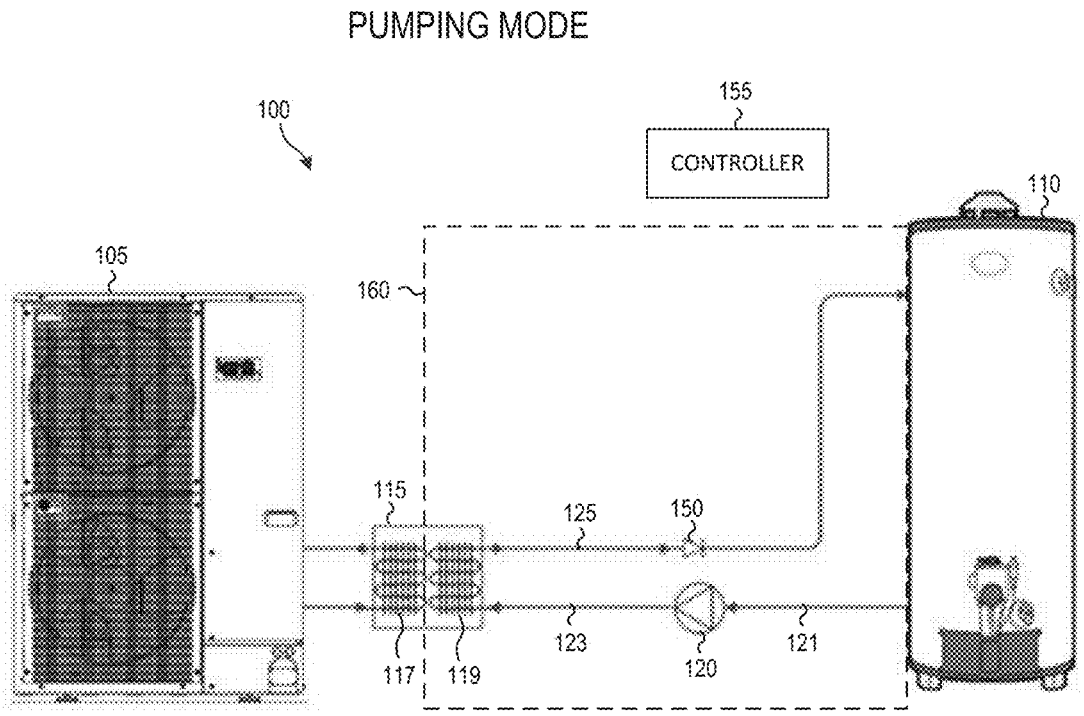
FIG. 2 is a block diagram of the supplemental heat-providing system of FIG. 1 in a pumping mode according to the first disclosed embodiment.

FIG. 2 is a block diagram of the supplemental heat-providing system 100 of FIG. 1 in a pumping mode according to the first disclosed embodiment. FIG. 2 is a representation of FIG. 1 in which pipes with open valves are shown as being solid pipes and pipes with closed valves are shown as being absent. Elements with the same reference number operate as described above with respect to FIG. 1.

As shown in FIG. 2, when the supplemental heat-providing system 100 is in the pumping mode, the controller 155 instructs the outdoor unit 105 to operate in a heating mode, instructs the water pump 120 to turn on and pump water, opens the first and third valves 130, 140, and closes the second and fourth valves 135, 145. This provides uninterrupted pathways from the hot water heater 110 to the water pump 120, from the water pump 120 to an inlet of the hot water pathway 119, and from an outlet of the hot water pathway 119 back to the hot water heater 110. With the water pump 120 activated, this will cause hot water from the hot water heater 110 to be circulated from the hot water heater 110, through the hot water pathway 119, and back to the hot water heater 110.

The water pump 120 will operate to draw water from the hot water heater 110 and push it through the first and second water pipes 121, 123 towards the hot water pathway 119, where it will pass through the hot water pathway 119 and continue through the third water pipe 125 back to the hot water heater 110. The check valve 150 will prevent any water from travelling back to the hot water pathway 119 along the third water pipe 125.

In addition, the outdoor unit 105 will pump refrigerant from the outdoor unit 105 through the refrigerant pathway 117 where it can exchange (i.e., absorb) heat from the hot water circulating through the hot water pathway 119.

In this way unheated refrigerant will continually be provided to the refrigerant pathway 117 and hot water will be continually provided to the hot water pathway 119. This will maximize the amount of heat transferred from the hot water to the refrigerant, allowing the refrigerant to more effectively heat one or more interior spaces in the building.

During the pumping mode, the ambient temperature surrounding the hydronic circuit 160 may well be below the freezing point of water. This will cause the hot water passing through the first, second, and third water pipes 121, 123, 125 to cool through heat exchange with the ambient air surrounding the pipes. This cooling may be minimized through the use of thermal insulation surrounding at least the first, second, and third water pipes 121, 123, 125.

Furthermore, the danger of the hot water being cooled so much that it freezes in the pipes can be minimized by maintaining a constant circulation of hot water through the hydronic circuit 160. Thus, even though the hot water may be cooled slightly as it passes through the first, second, and third water pipes 121, 123, 125, it will not remain there long enough for it to freeze. A constant supply of freshly heated water will be provided from the hot water heater 110.

Pump-Out Mode

When the outdoor unit 105 has exited the pumping mode for any reason, it may be desirable to remove the hot water from the hydronic circuit 160. The outdoor unit 105 might leave the pumping mode for any number of reasons. For example, the outside temperature may have risen above the secondary heating temperature threshold, meaning that the refrigerant no longer needs supplemental heat, the outdoor unit 105 may have been shut off, or the outdoor unit 105 may have been switched to a cooling mode.

One reason for removing the water from the hydronic circuit 160 is that the water remaining in the hydronic circuit 160 might freeze if the ambient temperature surrounding the water-refrigerant heat exchanger 115 were to drop below the freezing point of water without the water being circulated through the hydronic circuit 160. This could happen if the outdoor unit 105 were shut off or set to a cooling mode when the temperature is below freezing or later drops below freezing.

Furthermore, in some embodiments it may be desirable to pump the refrigerant out of the refrigerant pathway 117 as well as pumping hot water out of the hydronic circuit 160.

Figure 3:
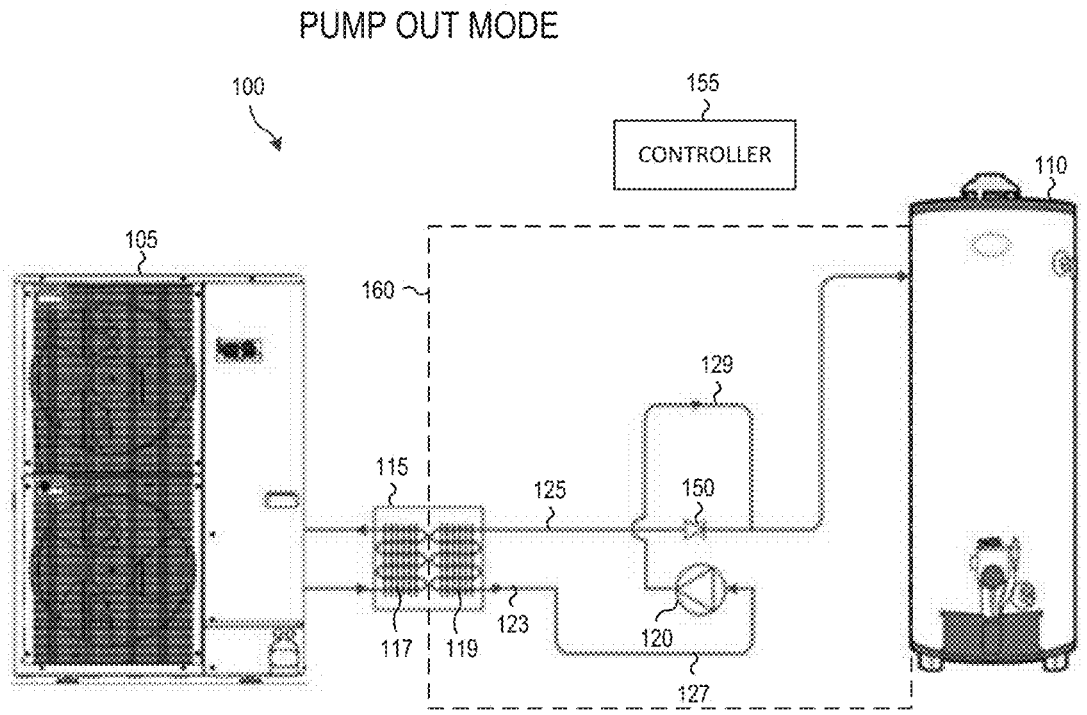
FIG. 3 is a block diagram of the supplemental heat-providing system of FIG. 1 in a pump-out mode according to the first disclosed embodiment.

FIG. 3 is a block diagram of the supplemental heat-providing system 100 of FIG. 1 in a pump-out mode according to the first disclosed embodiment. Elements with the same reference number operate as described above with respect to FIG. 1.

As shown in FIG. 3, when the supplemental heat-providing system 100 is in the pump-out mode, the controller 155 instructs the water pump 120 to turn on and pump water, closes the first and third valves 130, 140, and opens the second and fourth valves 135, 145. The controller 155 instructs the outdoor unit 105 to operate as is appropriate for the current operating mode of the outdoor unit (e.g., heating mode, cooling mode, off). This provides uninterrupted pathways from the hot water pathway 119 to the water pump 120 through the first bypass pipe 127 (and possibly the second water pipe 123), and from the water pump 120 to the hot water heater 110 through the second bypass pipe 129 (and possibly the third water pipe 125). With the water pump 120 activated, this will cause hot water to be drained from the hot water pathway 119 and the water pipes 121, 123, 125, 127, 129 and returned to the hot water heater 110.

The water pump 120 will operate to draw water from the hot water pathway 119 and push it through the first bypass pipe 127 (and possibly the second water pipe 123) and through the second bypass pipe 129 (and possibly the third water pipe 125) towards the hot water heater 110. The check valve 150 will prevent any water from travelling back to the hot water pathway 119 along the third water pipe 125.

In addition, the outdoor unit 105 may be instructed to pump refrigerant from the outdoor unit 105 from the refrigerant pathway 117 back to the outdoor unit 105, draining the refrigerant pathway 117 of refrigerant.

In this way the hydronic circuit 160 will be drained of water, and in some embodiments the refrigerant pathway 117 will be drained of refrigerant. This will leave the hydronic circuit 160 substantially empty of water, which will eliminate the chance of water accidentally freezing in the hydronic circuit 160.

In the disclosed embodiment, the pump-out mode will be maintained for a period of time deemed sufficient for substantially all water to be drained out of the hydronic circuit 160 and returned to the hot water heater 110.

Hydronic Standby Mode

When the outdoor unit 105 is in a cooling mode, it operates to cool one or more indoor spaces in the building through heat exchange with the refrigerant. When the outdoor unit 105 is turned off, it provides neither heating nor cooling to the one or more indoor spaces. In either case, there is no need for the refrigerant to be provided with supplemental heat.

As a result, during such times, the supplemental heat-providing system 100 operates in a hydronic shutdown mode in which the controller 155 does not activate the water pump 120, resulting in no hot water passing through the hydronic circuit 160. Since there is no hot water passing through the hydronic circuit the first, second, third, and fourth valves 130, 135, 140, 145 are in a 'standby' state in which it is irrelevant whether they are open or closed. In some embodiments they may default to open, in others they may default to closed, and in still others, some may be open and some may be closed.

Alternate Embodiments

In some alternate embodiments, mechanisms can be provided to prevent the hot water in the hydronic circuit 160 from cooling and ultimately freezing.

Figure 4:
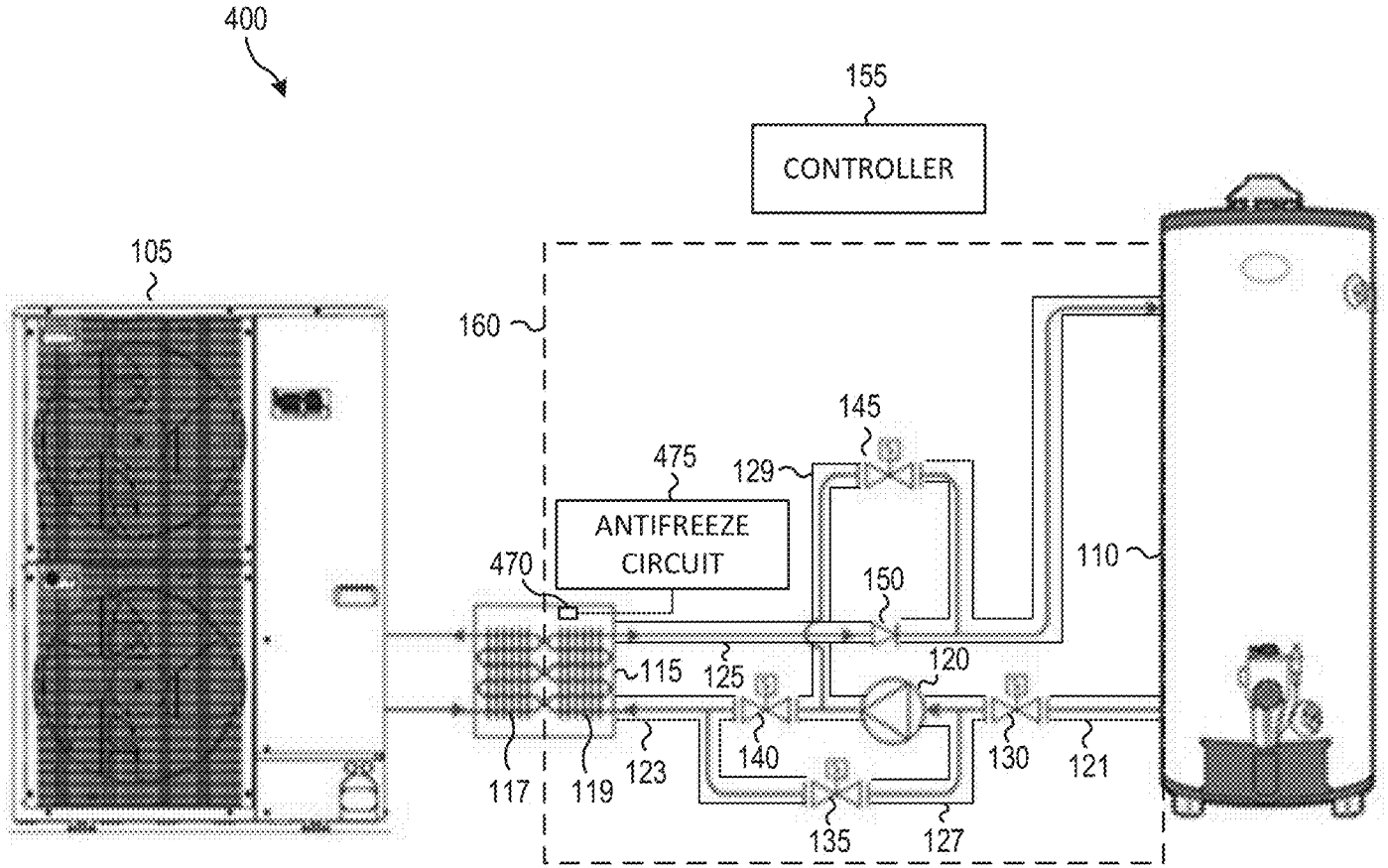
FIG. 4 is a block diagram of a supplemental heat-providing system according to an alternate disclosed embodiment.

FIG. 4 is a block diagram of a supplemental heat-providing system 400 according to an alternate disclosed embodiment.

As shown in FIG. 4, the supplemental heat-providing system 100 includes an outdoor unit 105, a hot water heater 110, a water-refrigerant heat exchanger 115, a water pump 120, a first water pipe 121, a second water pipe 123, a third water pipe 125, a first bypass pipe 127, a second bypass pipe 129, a first valve 130, a second valve 135, a third valve 140, a fourth valve 145, a check valve 150, a temperature sensor 470, and an antifreeze circuit 475. Elements with the same reference number operate as described above with respect to FIG. 1.

Similar to FIG. 1, the hot water pathway 119, water pump 120, first through third water pipes 121, 123, 125, first and second bypass pipes 127, 129, first through fourth valves 130, 135, 140, 145, check valve 150, temperature sensor 470, and antifreeze circuit 475 can be collectively referred to as a hydronic circuit 160.

As noted above with respect to FIG. 1, the various pipes 121, 123, 125, 127, 129 can be provided with thermal insulation surrounding them to minimize the transfer of heat between the pipes 121, 123, 125, 127, 129 and ambient outside air.

The temperature sensor 470 operates to sense the ambient temperature surrounding a point in the hydronic circuit 160 and provides that information to the antifreeze circuit and/or the controller 155. In some embodiments the temperature sensor 470 will detect the temperature of the water-refrigerant heat exchanger 115; in other embodiments the temperature sensor will detect the temperature of some other portion of the hydronic circuit 160, e.g., the temperature surrounding one of the pipes 121, 123, 125, 127, 129 or surrounding the water pump 120.

Alternate embodiments can employ multiple temperature sensors at multiple points throughout the hydronic circuit, each providing their temperature information to the antifreeze circuit 475 and/or the controller 155.

The antifreeze circuit 475 is configured to warm some or all of the hydronic circuit in certain circumstances. For example, the antifreeze circuit 475 could be configured to activate when the ambient outside temperature detected by the temperature sensor 470 falls below a set antifreeze temperature threshold (e.g., 32° F.).

The antifreeze circuit 475 may include an electric strip heater configured to heat the hot water pathway 119 and/or any or all of pipes 121, 123, 125, 127, 129 and/or the water pump 120. Similarly, the antifreeze circuit 475 may include an electric foil heater configured to heat the hot water pathway 119 and/or any or all of pipes 121, 123, 125, 127, 129 and/or the water pump 120. Alternate embodiments can employ other heating elements that are appropriate to heating heat exchangers, pipes, or water pumps. The antifreeze circuit 475 should not be limited to electric strip heaters and electric foil heaters.

In various embodiments, the antifreeze circuit 475 can be controlled by the controller 155 or dedicated control logic in the antifreeze circuit 475 itself. Temperature data required to control the operation of the antifreeze circuit 475 is provided to one or both of the controller 155 and antifreeze circuit 475 depending upon how operation of the antifreeze circuit 475 is controlled.

In embodiments that employ multiple temperature sensors, the controller 155/antifreeze circuit 475 could be configured to activate the antifreeze circuit 475 if any of the multiple temperature sensors indicate that an ambient temperature has fallen below a set antifreeze temperature threshold. In the alternative, the system 400 could trigger operation of the antifreeze circuit 475 based on a function of the detected temperatures (e.g., an average temperature).

Method of Operation

Figure 5:
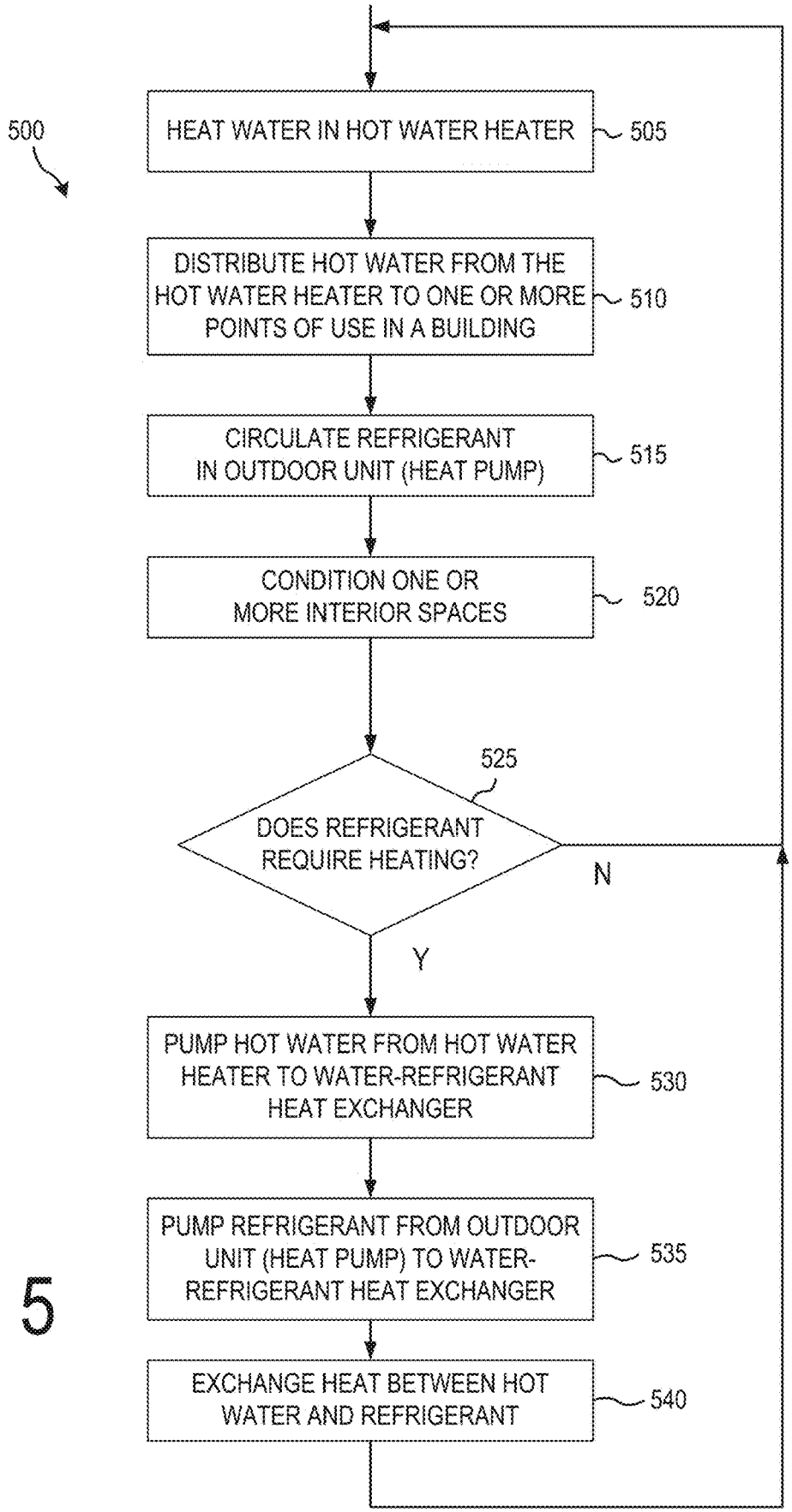
FIG. 5 is a flow chart describing the operation of a supplemental heat-providing operation according to disclosed embodiments.

FIG. 5 is a flow chart 500 describing the operation of a supplemental heat-providing operation according to disclosed embodiments.

As shown in FIG. 5, operation begins by heating the hot water in a hot water heater 505. As noted above, the hot water heater can be a residential or commercial hot water heater that heats potable water for residential or commercial use, or could be an industrial hot water heater that heats non-potable water for industrial use. The hot water heater could be a storage hot water heater or a tankless hot water heater.

The hot water heater then distributes the hot water from the hot water heater to one or more points of use in a building 510. This shows that the hot water heater is not a dedicated hot water heater used to provide hot water only to an outdoor unit in an air-conditioning system, but is a hot water heater in general use within the building.

Refrigerant is also circulated in an outdoor unit that can act as or include a heat pump 515. The refrigerant is circulated according to the general operation of the outdoor unit in its air-conditioning function.

The outdoor unit then conditions one or more spaces in a building using the refrigerant to exchange heat 520. Thus, the outdoor unit performs its function as part of an air-conditioning system.

The system then determines whether the refrigerant in the outdoor unit requires heating 525. For example, the system could make such a determination when the ambient temperature surrounding the outdoor unit falls below a threshold temperature (e.g., 0 to 20° F.). At this temperature, the refrigerant cannot extract enough heat from the ambient air to adequately heat an interior space in the building.

If the refrigerant does not require heating, then the operations of heating the hot water 505, distributing the hot water 510, circulating the refrigerant 515, conditioning the one or more interior spaces 520, and determining whether the refrigerant requires heating will be repeated.

If the refrigerant does require heating, then the system will pump hot water from the hot water heater to a water-refrigerant heat exchanger 530. One way to achieve this is through the use of a hydronic circuit that includes a water pump and a variety of pipes connecting the hot water heater to a hot water pathway in the water-refrigerant heat exchanger.

If the refrigerant requires heating, the system will also pump refrigerant from the outdoor unit to the water-refrigerant heat exchanger 535. The outdoor unit will be connected to the water-refrigerant heat exchanger by piping, and there will generally be a refrigerant pump, either in the outdoor unit or external to the outdoor unit, that can operate to circulate the refrigerant to the water-refrigerant heat exchanger.

As the hot water and refrigerant pass through the water-refrigerant heat exchanger, heat will be exchanged between the hot water and the refrigerant 540. Specifically, the refrigerant will absorb heat from the hot water to make it hot enough to perform an air-conditioning operation that heats one or more interior spaces in the building.

After the heat is exchanged between the hot water and the refrigerant, the process returns to the beginning and continues operation.

In the disclosed embodiment, the water-refrigerant heat exchanger will have separate hot water and refrigerant pathways that are close enough to each other that the refrigerant in the refrigerant pathway can extract heat from the hot water in the hot water pathway. In various embodiments, this could involve the use of parallel or intertwined refrigerant and hot water pathways.

Although FIG. 5 indicates that the hot water heater heats the water and distributes the water to one or more points of use before the outdoor unit circulates refrigerant and conditions one or more interior spaces, this is by way of example only. In practice, the hot water heater and the outdoor unit can operate in any order and will often operate in parallel.

In addition, While the various operations disclosed in FIG. 5 are shown as being discrete operations, they can, in fact, be performed continuously during operation. For example, the hot water heater could continually operate to heat water and distribute that water to one or more points in the building. Likewise, the outdoor unit could continually circulate refrigerant and condition one or more interior spaces. Similarly, the system could continually monitor for whether the refrigerant requires heating and take appropriate action whenever it does require heating. Thus, the order of operations in FIG. 5 is by way of example only.

Figure 6:
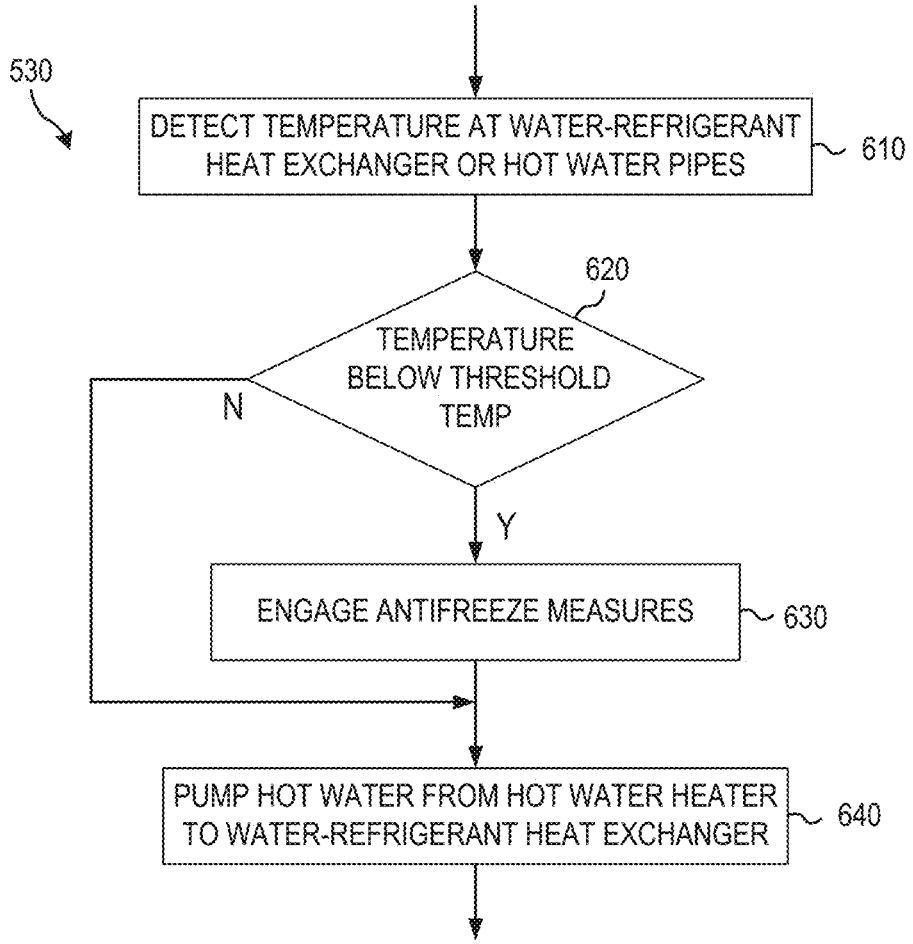
FIG. 6 is a flow chart describing the operation of pumping hot water from a hot water heater to a water-refrigerant heat exchanger in FIG. 5 according to a disclosed embodiment.

FIG. 6 is a flow chart describing the operation 530 of pumping hot water from a hot water heater to a water-refrigerant heat exchanger in FIG. 5 according to a disclosed embodiment. Specifically, FIG. 6 shows an operation in which antifreeze measures are provided to prevent the freezing of water being sent from the hot water heater to the water-refrigerant heat exchanger during freezing-cold weather.

As shown in FIG. 6, the operation 530 of pumping hot water from a hot water heater to a water-refrigerant heat exchanger can begin with detecting a temperature at the water-refrigerant heat exchanger or at the water pipes used to convey the hot water from the hot water heater to the water-refrigerant heat exchanger 610.

The system then determines whether the detected temperature is below a set antifreeze threshold temperature 620. This temperature is typically a temperature at which there is a danger that the hot water in water-refrigerant heat exchanger or the pipes connecting the hot water heater to the water-refrigerant heat exchanger will cool and ultimately freeze.

If the detected temperature is below the set antifreeze threshold temperature, then the system engages the available antifreeze measures 630. These measures could include maintaining constant pumping of the hot water or heating any or all of the water-refrigerant heat exchanger, a water pump, or the pipes connecting the hot water heater to the water-refrigerant heat exchanger.

Then, whether the antifreeze measures have been engaged or not, the system pumps hot water from the hot water heater to the water-refrigerant heat exchanger 640.

Figure 7:
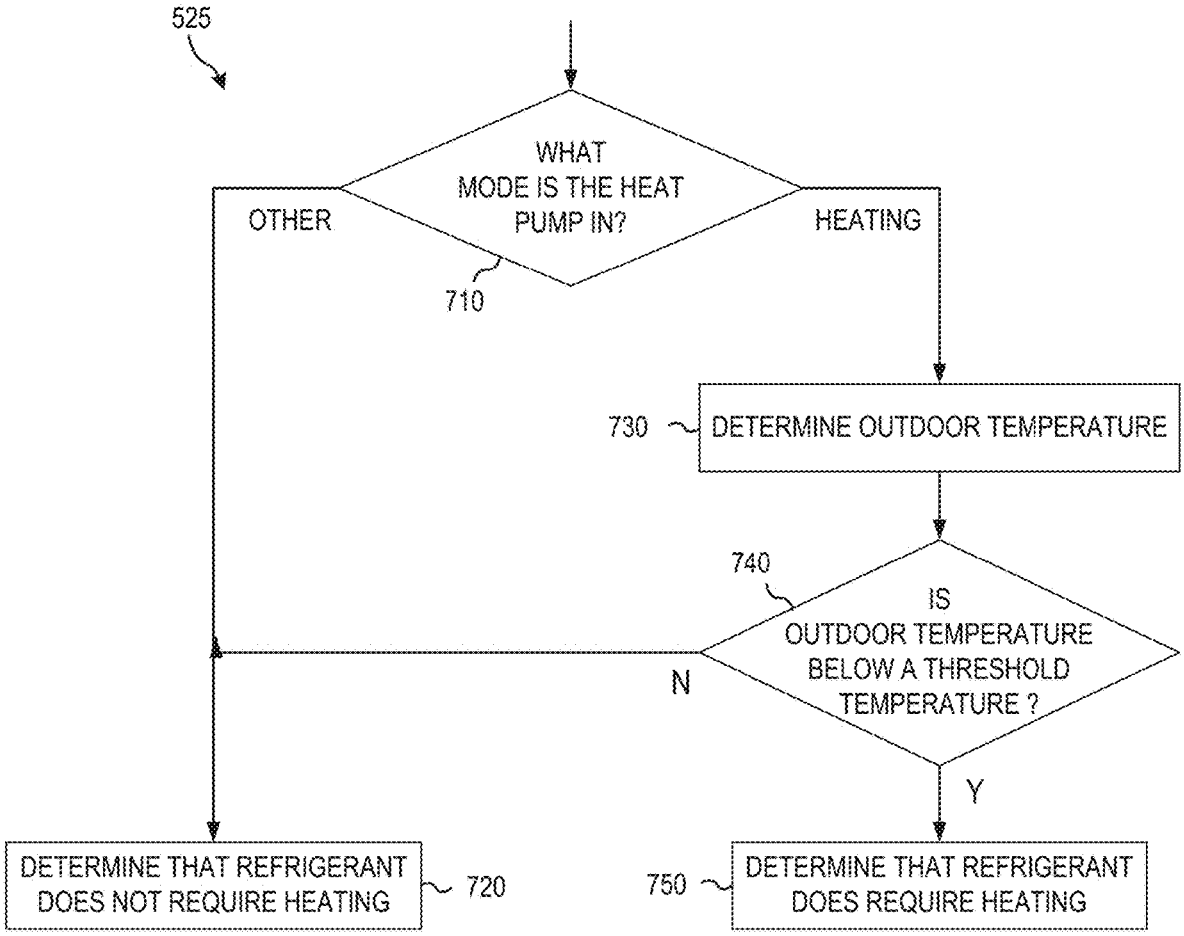
FIG. 7 is a flow chart describing the operation of determining whether a refrigerant requires heating in FIG. 5 according to disclosed embodiments.

FIG. 7 is a flow chart describing the operation 525 of determining whether a refrigerant requires heating in FIG. 5 according to disclosed embodiments.

The process begins by determining what mode the heat pump is in 710. This mode might include a heating mode, a cooling mode, a shut-down mode, etc. The only time that the refrigerant might require additional heating is when the heat pump is in a heating mode. Therefore, the system can actually make a simpler determination as to whether the heat pump is in a heating mode or a mode other than the heating mode.

If the heat pump is in a mode other than the heating mode, then the system can immediately determine that the refrigerant does not require supplemental heating 720.

If, however, the heat pump in in the heating mode, then the system proceeds to detect the outdoor temperature around the outdoor unit 730.

The system then uses this detected temperature to determine whether the outdoor temperature is below a set threshold temperature 740. This threshold temperature is an ambient temperature below which the refrigerant cannot extract enough heat out of the outside air to sufficiently heat the indoor space in the building. This threshold temperature can be set based on a desired effectiveness of the heat pump and may vary in different embodiments. In the disclosed embodiment, the threshold temperature is in the range of 0 to 20° F., though this is by way of example only.

If the outdoor temperature is not below the set threshold temperature, then the system determines that the refrigerant does not require heating 720.

If, however, the outdoor temperature is below the set threshold temperature, then the system determines that the refrigerant does require heating 750. The system can then proceed to provide supplemental heating to the refrigerant as set forth in FIG. 5.

In other embodiments, the system could use an alternative trigger to determine whether the refrigerant required heating. For example, the system could check whether the temperature of a refrigerant operating in a heat pump in a heating mode was below a temperature threshold, and determine that the refrigerant required additional heating when the temperature of the refrigerant fell below a set temperature threshold.

Alternate Embodiments

Figure 8:
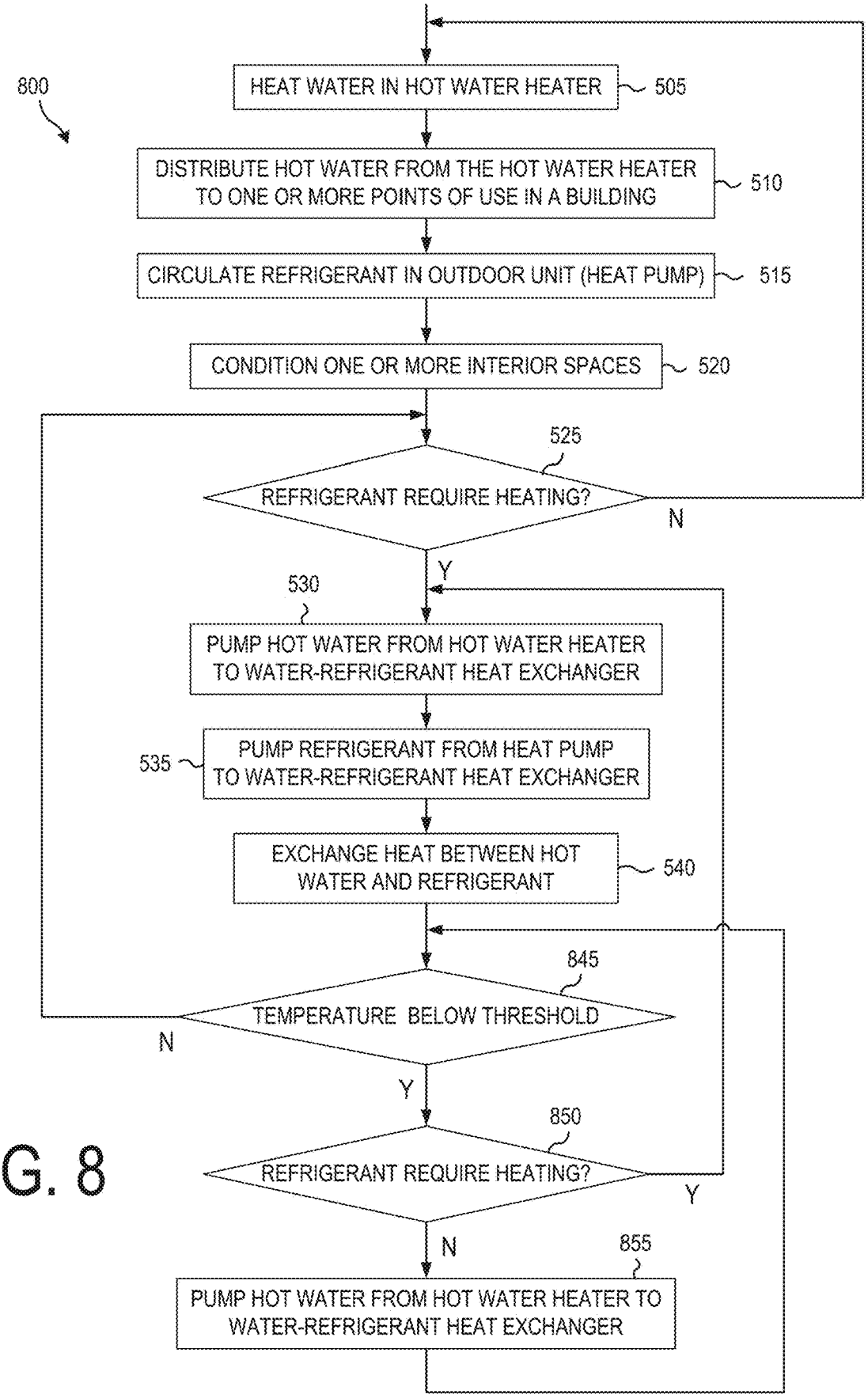
FIG. 8 is a flow chart describing the operation of a supplemental heat-providing operation according to alternate disclosed embodiments.

FIG. 8 is a flow chart describing the operation 800 of a supplemental heat-providing operation according to alternate disclosed embodiments. In this embodiment, the supplemental heat-providing system contains a mechanism for preventing hot water pumped from the hot water heater to the water-refrigerant heat exchanger from cooling down or even freezing in the water-refrigerant heat exchanger or the pipes between the hot water heater and the water-refrigerant heat exchanger by keeping the refrigerant continually pumping when the ambient temperature surrounding the water-refrigerant heat exchanger and the pipes between the hot water heater and the water-refrigerant heat exchanger drops below a potentially freezing temperature threshold.

The operation 800 of FIG. 8 is similar to the operation of FIG. 5, and individual operations that have the same reference number as those in FIG. 5 will not be again described. Those operations proceed as described above with respect to FIG. 5.

As shown in FIG. 8, the supplemental heat-providing system heats water in a hot water heater 505, distributes the hot water to one or more points of use 510, circulates refrigerant in the outdoor unit 515, conditions one or more interior space 520, and determines whether the refrigerant requires heating 525. Then if the refrigerant does require heating, the system pumps hot water from the hot water heater to the water-refrigerant heat exchanger 530, pumps refrigerant from the heat pump to the water-refrigerant heat exchanger 535, and exchanges heat between the hot water and the refrigerant in the water-refrigerant heat exchanger 540.

However, in this embodiment, the system takes extra precautions to prevent the hot water being pumped from the hot water heater to the water-refrigerant heat exchanger from cooling too much or even freezing. Specifically, when the ambient temperature surrounding the water pipes and water-refrigerant heat exchanger drops too low, the system keeps pumping the hot water from the hot water heater to the water-refrigerant heat exchanger.

Once the hot water and refrigerant are provided to the water-refrigerant heat exchanger and are exchanging heat, the system determines whether the ambient temperature surrounding the water-refrigerant heat exchanger and/or the hot water pipes has fallen below a set freezing threshold temperature 845. This freezing threshold temperature is typically a temperature at which there is a chance of the hot water in the water-refrigerant heat exchanger and water pipes freezing and causing damage to the water-refrigerant heat exchanger and the water pipes. In the disclosed embodiment, the freezing threshold temperature is somewhere close to the freezing temperature of water (32° F.), though different thresholds could be used, as desired.

If the detected temperature is not below the freezing threshold temperature, then the system returns to determining whether the refrigerant requires heating 525, and proceeds from there as described in FIG. 5.

If the detected temperature is below the freezing temperature threshold, then the system again determines whether the refrigerant requires heating 850. This operation is similar to the first determination of whether the refrigerant requires heating 525, and can be performed just as described with respect to that operation.

If the refrigerant does require heating, then the system continues to pump water from the hot water heater to the water-refrigerant heat exchanger 530, pump refrigerant from the heat pump to the water-refrigerant heat exchanger 535, and exchange heat between the hot water and the refrigerant 540.

If the refrigerant does not require heating, then the system simply pumps hot water from the hot water heater to the water-refrigerant heat exchanger 855. This operation is similar to the first operation of pumping hot water from the hot water heater to the water-refrigerant heat exchanger, and is carried out in the same way. However, since there is no need to provide supplemental heat to the refrigerant, it is not necessary to pump the refrigerant from the heat pump to the water-refrigerant heat exchanger, nor to exchange heat between the hot water and the refrigerant.

In this way, the system can maintain a constant flow of hot water through the water-refrigerant heat exchanger and the water pipes between the hot water heater and the water-refrigerant heat exchanger when the temperature is low enough that there is a danger of water remaining in the water-refrigerant heat exchanger or the water pipes freezing and damaging the water-refrigerant heat exchanger or the water pipes.

The process 800 of FIG. 8 is simply one example of how a constant flow of hot water can be maintained when circumstances require. Alternate embodiments are possible in which the flow of hot water is maintained in a different manner.

In alternate embodiments, when the temperature falls below the freezing temperature threshold and the refrigerant does not require heating, the system can perform a pump-out operation to drain the water-refrigerant heat exchanger and the water pipes of any water, returning the water to the hot water heater.

Figure 9:
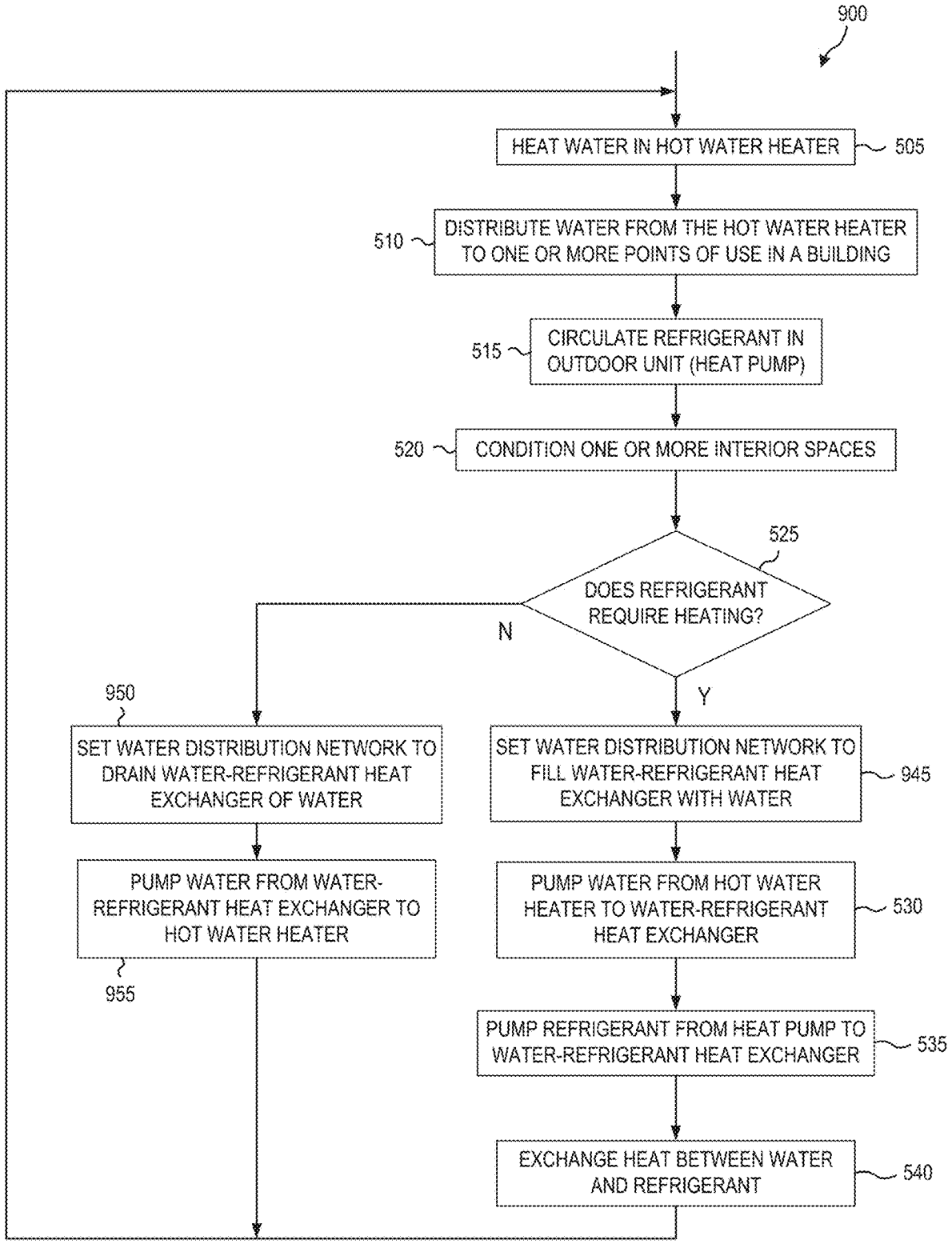
FIG. 9 is a flow chart describing the operation of a supplemental heat-providing operation according to other alternate disclosed embodiments.

FIG. 9 is a flow chart describing the operation 900 of a supplemental heat-providing operation according to other alternate disclosed embodiments. This embodiment operates to drain the water-refrigerant heat exchanger and the water pipes of water when the refrigerant does not require heating. In this way, even if the temperature later falls below the freezing point of water, there will be no danger of there being any substantial amount of water in the water-refrigerant heat exchanger, the water pump, or the water pipes to freeze.

The operation 900 of FIG. 9 is similar to the operation of FIG. 5, and individual operations that have the same reference number as those in FIG. 5 will not be again described. Those operations proceed as described above with respect to FIG. 5.

As shown in FIG. 9, the supplemental heat-providing system heats water in a hot water heater 505, distributes the hot water to one or more points of use 510, circulates refrigerant in the outdoor unit 515, conditions one or more interior space 520, and determines whether the refrigerant requires heating 525. Then if the refrigerant does require heating, the system pumps hot water from the hot water heater to the water-refrigerant heat exchanger 530, pumps refrigerant from the heat pump to the water-refrigerant heat exchanger 535, and exchanges heat between the hot water and the refrigerant in the water-refrigerant heat exchanger 540.

In this embodiment, when the refrigerant does require supplemental heating, the system sets a water distribution network to fill the water-refrigerant heat exchanger with hot water 945. This operation may be required since the system may have previously drained the water-refrigerant heat exchanger and the water pipes of water.

The system then proceeds to pump hot water from the hot water heater to the water-refrigerant heat exchanger 530, pump refrigerant from the heat pump to the water-refrigerant heat exchanger 535, and exchange heat between the hot water and the refrigerant 540, as described above with respect to FIG. 5.

If, however, the refrigerant does not require supplemental heating, the system in this embodiment proceeds to set the water distribution networks (i.e., a hydronic circuit containing the water-refrigerant heat exchanger, a water pump and the water pipes) to drain the water-refrigerant heat exchanger and the water pipes of water 950.

The system then proceeds to pump water from the water-refrigerant heat exchanger to the hot water heater 955. This drains the hydronic circuit of water, meaning that even if the ambient outdoor temperature should drop below the freezing point of water, there will be little to no water in the hydronic circuit to freeze. Even if there is some residual water in the hydronic circuit, it will generally be a small enough amount that even if it does freeze, it will not cause damage to the water-refrigerant heat exchanger, the water pump, or the water pipes.

Once the system has either circulated hot water and refrigerant into the water-refrigerant heat exchanger or drained the hydronic circuit of water, it returns to heating water in a hot water heater 505, distributing the hot water to one or more points of use 510, circulating refrigerant in the outdoor unit 515, and conditioning one or more interior space 520, and determines whether the refrigerant requires heating 525.

CONCLUSION

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled. The various circuits described above can be implemented in discrete circuits or integrated circuits, as desired by implementation.

What is claimed is:

1. A supplemental heat-providing system for heating a refrigerant, comprising:

an outdoor unit that can operate as a heat pump located outside a building configured to use the refrigerant to provide heat to an indoor space inside the building;

a hot water heater located inside the building and connected to one or more points of use in the building, the hot water heater being configured to heat water and provide the water to the one or more points of use;

a water-refrigerant heat exchanger containing a refrigerant pathway and a water pathway, configured to pass the refrigerant from the outdoor unit through the refrigerant pathway, to pass the water from the hot water heater through the water pathway, and to exchange heat from the water in the water pathway to the refrigerant in the refrigerant pathway;

a water pump configured to selectively pump the water from the hot water heater through the water pathway in the water-refrigerant heat exchanger;

a first water pipe connected between the hot water heater and an input of the water pump;

a second water pipe connected between an output of the water pump and the water pathway of the water-refrigerant heat exchanger;

a third water pipe connected between the water pathway of the water-refrigerant heat exchanger and the hot water heater;

a first bypass pipe connected between the input of the water pump and the water pathway of the water-refrigerant heat exchanger;

a second bypass pipe connected between the output of the water pump and the hot water heater;

a check valve located on the third water pipe, configured to prevent water flow from the hot water heater to the water pathway of the water-refrigerant heat exchanger along the third water pipe;

a first valve located on the first water pipe and configured to control water flow between the hot water heater and the input of the water pump;

a second valve located on the first bypass pipe, configured to control water flow between the input of the water pump and the water pathway of the water-refrigerant heat exchanger;

a third valve located on the second water pipe, configured to control water flow between the output of the water pump and the water pathway of the water-refrigerant heat exchanger; and a fourth valve located on the second bypass pipe, configured to control water flow between the output of the water pump and the hot water heater.

2. The supplemental heat-providing system of claim 1, wherein the water is potable.

3. The supplemental heat-providing system of claim 1, wherein the first, second, third, and fourth valves are all solenoid valves.

4. The supplemental heat-providing system of claim 1, further comprising a temperature sensor configured to determine a temperature of at least one of the first, second, third, or fourth water pipes or the water-refrigerant heat exchanger.

5. The supplemental heat-providing system of claim 1, further comprising thermal insulation surrounding at least one of the first, second, third, and fourth water pipes.

6. The supplemental heat-providing system of claim 1, further comprising an antifreeze circuit configured to heat at least one of the first, second, third, or fourth water pipes or the water-refrigerant heat exchanger.

7. The supplemental heat-providing system of claim 6, wherein the antifreeze circuit comprises one of an electric strip heater or an electric foil heater.

8. The supplemental heat-providing system of claim 1, wherein the water pump is further configured to selectively pump water out of the water-refrigerant heat exchanger and into the hot water heater via at least the first bypass pipe and the second bypass pipe.

9. The supplemental heat-providing system of claim 1, wherein the fourth valve is further configured to have an open position that allows water to flow through the fourth valve and a closed position that prevents water from flowing through the fourth valve.

* * * * *